US006877810B2

(12) United States Patent
Haney et al.

(10) Patent No.: US 6,877,810 B2
(45) Date of Patent: Apr. 12, 2005

(54) GLIDER BENCH

(75) Inventors: Thayne B. Haney, Syracuse, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/378,763

(22) Filed: Mar. 4, 2003

(65) Prior Publication Data

US 2003/0209928 A1 Nov. 13, 2003

Related U.S. Application Data

(63) Continuation-in-part of application No. 29/160,295, filed on May 8, 2002, now Pat. No. Des. 472,721.

(51) Int. Cl.[7] ..... A47C 3/00

(52) U.S. Cl. ..... 297/281; 297/282; 297/452.65; 297/DIG. 2

(58) Field of Search ..... 297/281, 282, 297/DIG. 2, 452.65, 451.8

(56) References Cited

U.S. PATENT DOCUMENTS

| | | | | |
|---|---|---|---|---|
| 1,271,453 A | | 7/1918 | Elzey | |
| 1,325,358 A | | 12/1919 | Elzey | |
| 1,959,032 A | * | 5/1934 | McGowen | 297/282 |
| D103,956 S | | 4/1937 | Rink | |
| D121,462 S | | 7/1940 | Tabb | |
| 2,311,482 A | * | 2/1943 | Smith | 297/281 |
| D135,777 S | | 6/1943 | Smith | |
| D152,129 S | | 12/1948 | Sanford | |
| D153,162 S | | 3/1949 | Nelems | |
| D154,356 S | | 7/1949 | Allmand | |
| 2,517,278 A | * | 8/1950 | Benson | 297/282 |
| D165,835 S | | 2/1952 | Glass | |
| 3,047,334 A | | 7/1962 | Vanderminden | |
| D273,444 S | | 4/1984 | Harper, Jr. et al. | |
| 4,796,949 A | * | 1/1989 | Boyce | 297/282 |
| D313,515 S | | 1/1991 | Wood | |
| D325,304 S | | 4/1992 | Grosfillex | |
| D335,971 S | | 6/1993 | Hess | |
| D342,629 S | | 12/1993 | Tseng | |
| D355,783 S | | 2/1995 | Noll | |
| D369,922 S | | 5/1996 | Kirn et al. | |
| 5,667,273 A | | 9/1997 | Noll | |
| D385,425 S | | 10/1997 | Goetz | |
| D419,004 S | | 1/2000 | Collins | |
| D419,315 S | | 1/2000 | Durbin et al. | |
| D423,801 S | | 5/2000 | Noll | |
| D425,718 S | | 5/2000 | Van Valderen | |
| D432,323 S | | 10/2000 | Pomeroy et al. | |
| D434,573 S | | 12/2000 | Noll | |
| D439,068 S | | 3/2001 | Vanderbyl | |
| 6,199,950 B1 | | 3/2001 | Noll | |
| D457,339 S | | 5/2002 | Liu | |
| D457,342 S | | 5/2002 | Muller | |
| 6,783,184 B2 | * | 8/2004 | DiBattista et al. | 297/452.14 |

FOREIGN PATENT DOCUMENTS

JP 11-318634 * 11/1999

* cited by examiner

*Primary Examiner*—Anthony D Barfield
(74) *Attorney, Agent, or Firm*—Workman Nydegger

(57) ABSTRACT

A glider bench includes a base that remains in a generally stationary position when the glider bench is in use and a frame that is movable relative to the base. The frame may include a back and seat support portion that is sized and configured to support a bench seat and a bench back. The bench seat and the bench back are preferably constructed from blow-molded plastic. The bench seat and back may include a plurality of depressions that are desirably configured to increase the strength of the bench seat and back. The bench seat and back may also include one or more screw bosses, receiving channels and/or grooves. Desirably, the depressions, screw bosses, receiving channels and/or grooves are formed in the bench seat or bench back as part of a unitary, one-piece construction.

21 Claims, 7 Drawing Sheets

GLIDER BENCH

CROSS-REFERENCE TO RELATED APPLICATIONS

This application is a continuation-in-part of U.S. Design patent application Ser. No. 29/160,295, filed May 8, 2002 now U.S. Pat. No. Des. 472,721, entitled GLIDER BENCH, which is incorporated by reference in its entirety.

BACKGROUND OF THE INVENTION

1. Field of the Invention

The present invention relates generally to chairs and benches, and more specifically to glider benches.

2. Description of Related Art

Benches are well known in the art and it is known to construct benches with a variety of different configurations. For example, benches may include one or more arms or armrests. These arms or armrests may be placed at the outer edges of the bench and one or more arms may be disposed towards the center of the bench. Conventional benches may also include a seat and a back that are integrally formed as a single component, or the seat and back may consist of separate components that are joined together or spaced apart by a distance.

Conventional benches are often constructed from materials such as wood. In particular, the seat and back of many conventional benches are often constructed from a number of wooden boards or slats that are connected to a frame. Disadvantageously, the wood may quickly deteriorate when exposed to the elements. For example, the wood may warp or rot when used outdoors. Additionally, the wood is often limited in strength because it may crack or fracture if over-stressed. Further, the wood must be treated, such as sanding, staining and painting, before use and the wood frequently requires periodic maintenance such as repainting and replacement of broken boards.

Conventional benches may also be constructed from metal. For example, the seat and back portions of the bench may be constructed from metal but these large metal components often rust or corrode over time, especially when the benches are placed outdoors.

Known benches may also include a metal or wooden frame that is used to support the bench seat and back. A large number of screws are typically used to attach the bench seat and back to the frame, especially if the seat and back are constructed from wood. The screws, however, may loosen and require replacement over time. Additionally, connecting numerous boards to the frame with the screws requires a substantial amount of time, which increases manufacturing time and costs. Thus, conventional benches are often relatively expensive because the benches are constructed from multiple components that are connected by a large number of screws.

In addition, because conventional benches are often constructed from materials such as wood and metal, the benches are heavy. For instance, if the seat and back are constructed from wood, a heavy and sturdy frame is required to support the heavy wooden seat and back. The heavy seat and back may also require heavier-duty fasteners to connect the seat and back to the frame. Therefore, conventional benches are often undesirably heavy.

The heavy benches are often expensive to transport and ship. For example, if the benches are being shipped from the manufacturer to a retailer or consumer, the shipping costs of the heavy benches is significant. Additionally, if the consumer purchases the bench at a retail store, such as a hardware store or home center, then the consumer must be able to take the bench home. Consumers, however, may be reluctant to purchase benches that are too heavy to easily transport. For example, many consumers may be unwilling to purchase a bench that is difficult to move to the checkout stand, load into a vehicle and place in a desired location such as the consumer's backyard. Additionally, even if the bench is placed in an originally desired location, consumers may want to move the bench. For example, some consumers may desire to use a bench indoors, outdoors or in different locations depending upon the time of the year. Benches that are too heavy, however, may be difficult or impossible for some consumers to move.

Conventional benches may also be shipped in unassembled configurations to reduce the size and bulk of the packaging. While this may reduce the costs to ship the benches, the retailer or consumer may have difficulty in assembling the benches, especially if the benches are heavy. Retailers and consumers may also have difficulty assembling conventional benches because of the multiple components and plurality of screws used to assemble the benches. Accordingly, many consumers may not want to purchase conventional benches because these known benches are often heavy and difficult to assemble.

BRIEF SUMMARY OF THE INVENTION

A need therefore exists for a bench that eliminates the above-described disadvantages and problems.

One aspect of the invention is a glider bench that rocks or swings. Desirably, the glider bench has a smooth gliding motion that freely swings backwards and forwards. Preferably, the glider bench moves only forwards and backwards without any significant rotational or sideways movement.

Another aspect is the glider bench may include a generally stationary frame and movable bench connected to the frame. The bench may be pivotally connected to the frame by a linkage or glider mechanism. The linkage mechanism, for example, may include one or more links connecting the bench to the frame and the links may be in a parallelogram configuration.

Yet another aspect of the glider bench is the bench seat and back are preferably lightweight because the seat and back are constructed from plastic. In particular, the bench seat and back are preferably constructed from blow-molded plastic in order to create a lightweight structure. Because the bench seat and back are preferably constructed from lightweight plastic materials, the fame does not have to support a large amount of weight and that may allow a lighter-weight frame to be used. For example, the frame may be constructed by hollow metal tubing and this may allow a glider bench that is very lightweight to be constructed.

Still another aspect of the glider bench is the bench seat and back may include one or more depressions, "tack-offs" or "kiss-offs." The depressions, which extend from one surface towards another surface, are desirably sized and configured to increase the strength and/or rigidity of the bench seat and back. Preferably, the depressions extend from one surface and contact or engage an opposing surface, but the depressions do not have to contact or engage the opposing surface. The depressions are desirably formed in the rear surface of the bench back and/or in the bottom surface of the bench seat so that the depressions are generally not visible. The depressions, however, may be formed in the front surface and/or any other surfaces of the bench seat and back.

For example, one or more depressions may be formed in the rear surface of the bench back and one or more depressions may be formed in the front surface of the back, and these opposing depressions may be generally aligned. At least a portion of these opposing depressions preferably contact or engage each other, but the opposing depressions do not touch or engage.

Advantageously, the blow-molded plastic bench seat and back are relatively strong because they include two or more opposing walls or surfaces that are separated by a given distance. The opposing walls help create a high-strength, rigid back and seat. Because the interior portions of the bench seat and back are generally hollow, that creates a lightweight back and seat. Significantly, the strong and sturdy back and seat can withstand repeated impacts with various objects and may allow the glider bench to be used for an extended period of time.

Significantly, the bench seat and back can be quickly and easily constructed because these components are preferably constructed using a blow-molded plastic process. Advantageously, the blow-molding process allows the double walls and any suitable number of depressions to be quickly and easily formed in the bench seat and back. As discussed above, the double walls and depressions allow a strong and sturdy bench seat and back to be constructed. These and other features also allow the back and seat to be constructed with relatively thin plastic walls and that reduces the amount of materials used to construct the back and seat. This saves manufacturing costs and reduces the amount of resources required to construct the back and seat. The thin plastic walls also allow the back and seat to be cooled more quickly during the manufacturing process, and that saves time and further decreases costs.

Yet another aspect of the glider bench is the bench seat and back can be constructed in any desired configuration, shape, size and design depending, for example, upon the intended use and/or configuration of the glider bench. Significantly, if the bench seat and back are constructed from blow-molded plastic, they can easily be formed into any desired size, configuration, and color. In addition, the blow-molded plastic bench seat and back are durable, weather resistant and generally temperature insensitive. The blow-molded plastic bench seat and back, in contrast to many conventional benches, do not corrode, rust or otherwise deteriorate over time.

Advantageously, because the bench seat and back may be constructed from blow-molded plastic, the seat and back are generally hollow and this allows a glider bench with reduced weight to be constructed. Significantly, the lightweight glider bench can be easily transported, which decreases shipping costs. Additionally, the consumer may appreciate the reduced weight because they can much more easily transport and assemble the glider bench. Further, because the bench seat and back are lightweight, the glider bench does not require a large or heavy duty frame to support the back and seat.

The blow-molded plastic seat and back allow a strong, rigid and sturdy glider bench to be constructed. Significantly, the blow-molded bench seat and back may form structural members of the glider bench, or the back and seat may be supported by the frame. In addition, the blow-molded construction of the bench seat and back may allow other features to be formed in the bench and this may reduce the number of steps required in the manufacturing process, which may reduce the overall cost of the glider bench. For example, one or more grooves may be formed in the seat and/or back to allow the seat or back to be mounted to the frame, and one or more depressions may be formed in the seat and/or back to increase the strength and structural integrity of the blow-molded components.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF PREFERRED EMBODIMENTS

The present invention is directed towards a glider bench. The principles of the present invention, however, are not limited to glider benches. It will be understood that, in light of the present disclosure, the glider bench disclosed herein can be successfully used in connection with other types of chairs, benches and furniture.

Additionally, to assist in the description of the glider bench, words such as top, bottom, front, rear, right and left are used to describe the accompanying figures. It will be appreciated, however, that the glider bench can be located in a variety of desired positions—including various angles, sideways and even upside down. A detailed description of the glider bench now follows.

Figure 1:
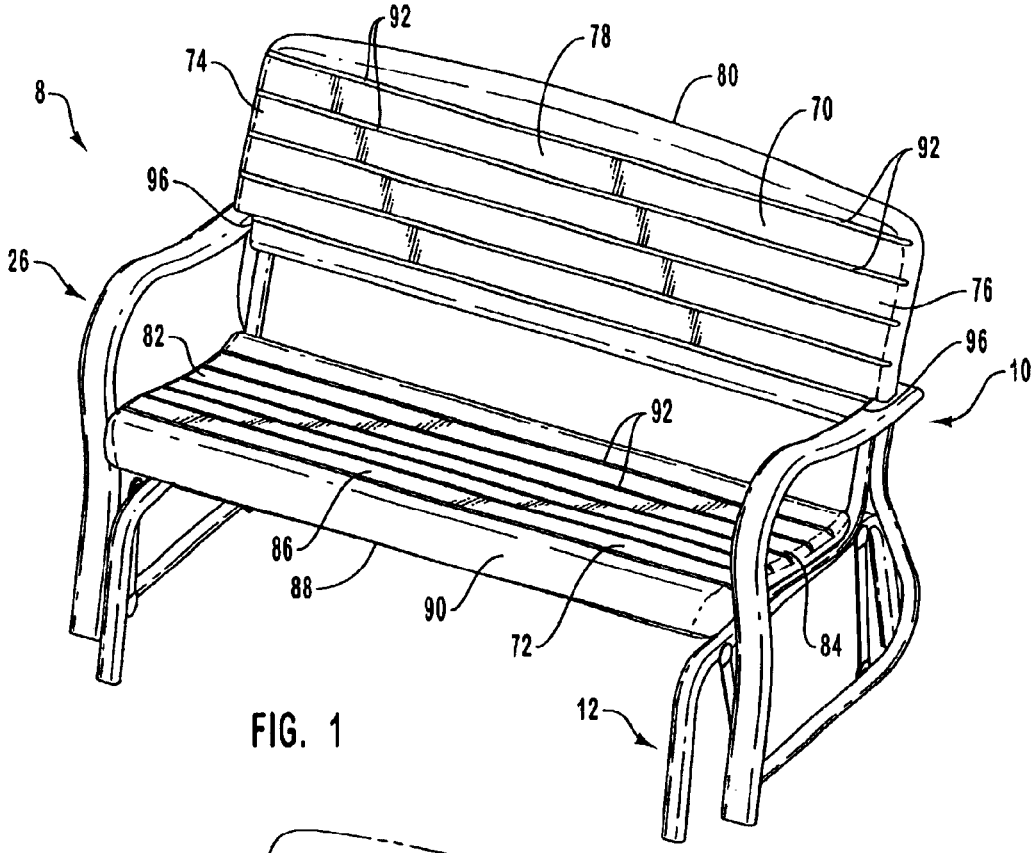
FIG. 1 is a perspective view of a glider bench in accordance with a preferred embodiment of the invention.

As seen in FIG. 1, the glider bench 8 includes a bench portion 10 that is movably connected to a base 12. In particular, the base 12 remains in a generally fixed position relative to a support surface, such as a floor or the ground, and the bench 10 is capable of being moved relative to the base. Desirably, as described in more detail below, the bench 10 freely swings or rocks back and forth relative to the base 12 to create a smooth gliding motion.

Figure 2:
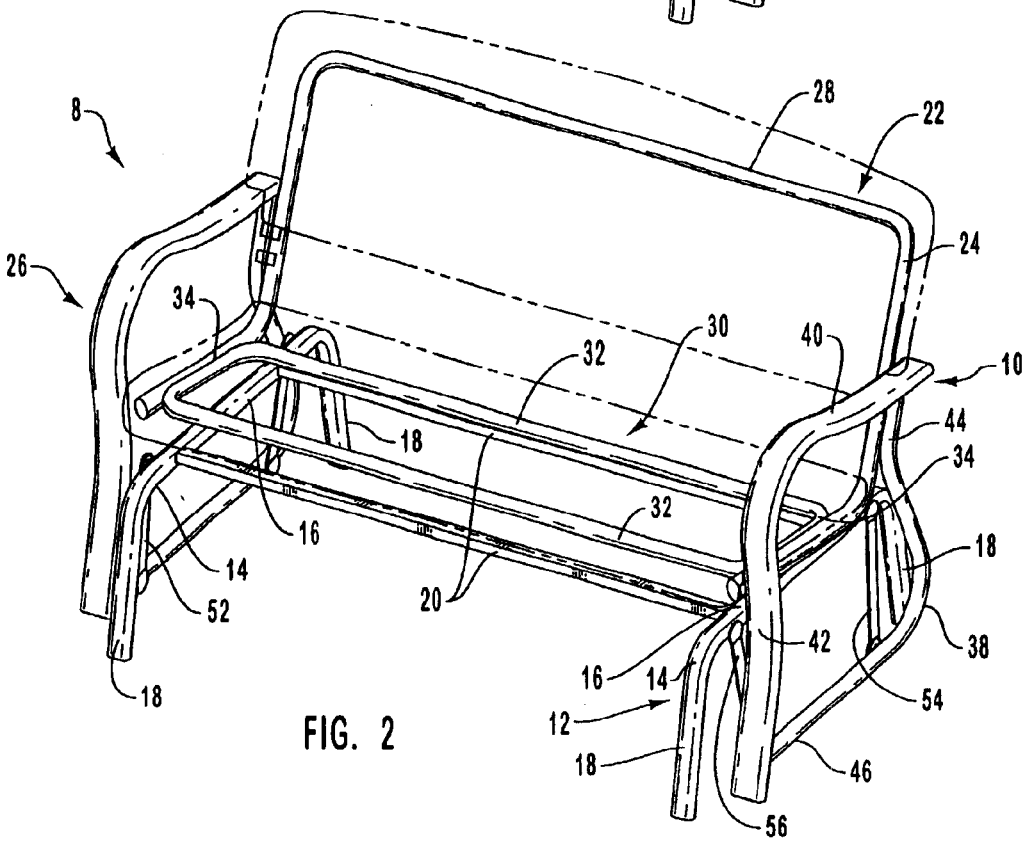
FIG. 2 is a perspective view of the glider bench shown in FIG. 1, illustrating the seat and back of the bench in broken lines.

As more clearly shown in FIG. 2, the base 12 includes two support members 14 that are located near the opposing ends of the glider bench 8. The support members 14 may have a generally U-shaped configuration with a connecting member 16 and two downwardly extending legs 18. The legs 18 and the connecting member 16 of the support member 14 are preferably a single component, but it will be appreciated that the support member may be constructed from two or more interconnected components. The two support members 14 are connected by two elongated members 20 to form the base 12. The elongated members 20 are preferably welded to the support members 14 to create a strong and sturdy base 12, but the elongated members may be connected to the support members in any suitable manner such as fasteners, adhesives and the like. It will be appreciated that the base 12 could be a single, unitary component or multiple components that are interconnected. Further, the size and configuration of the base 12 may depend, for example, upon the size and configuration of the glider bench 8.

The base 12, including the support members 14 and the elongated members 20, is preferably constructed from metal and, in particular, from metal tubes that are bent or formed into the desired shape and configuration. It will be appreciated, however, that the base 12 may be constructed from other suitable materials and the base may have other appropriate shapes and configurations depending, for example, upon the type of materials used to construct the base or the intended use of the glider bench 8.

The bench portion 10 of the glider bench 8 is supported by a frame 22. The frame 22, as best seen in FIG. 2, includes a back and seat support 24 and an arm support 26. In greater detail, the back and seat support 24 includes a back support portion 28 and a seat support portion 30. The back support portion 28 includes a generally upwardly extending portion with a generally U-shaped configuration and two forwardly extending arms that are connected to the seat support portion 30. The seat support portion 30 includes two elongated support members 32 that are interconnected by two connecting arms 34. Desirably, the seat support portion 30 has a generally rectangular configuration but it will be understood that the seat support portion may have other suitable configurations depending, for example, upon the size and configuration of the frame 22 and/or the glider bench 8. The seat support portion 30 is preferably welded to the back support portion 28 to create the back and seat support 24, but the seat support portion and the back support portion may be connected in any suitable manner. In addition, the back and seat support portions 28, 30 could be constructed from a single or multiple components.

The back and seat support portions 28, 30 are preferably constructed from metal and, in particular, from metal tubes that may be bent or formed into the desired shape and configuration. It will be appreciated, however, that the back and seat support portions 28, 30 may be constructed from any suitable materials and these components may have other appropriate shapes and configurations depending, for example, upon the type of materials used to construct the back and seat support 24 or the intended use of the glider bench 8. It will also be appreciated that the back and seat support 24 may have other suitable configurations depending, for example, upon the configuration and intended use of the glider bench 8.

Figure 3:
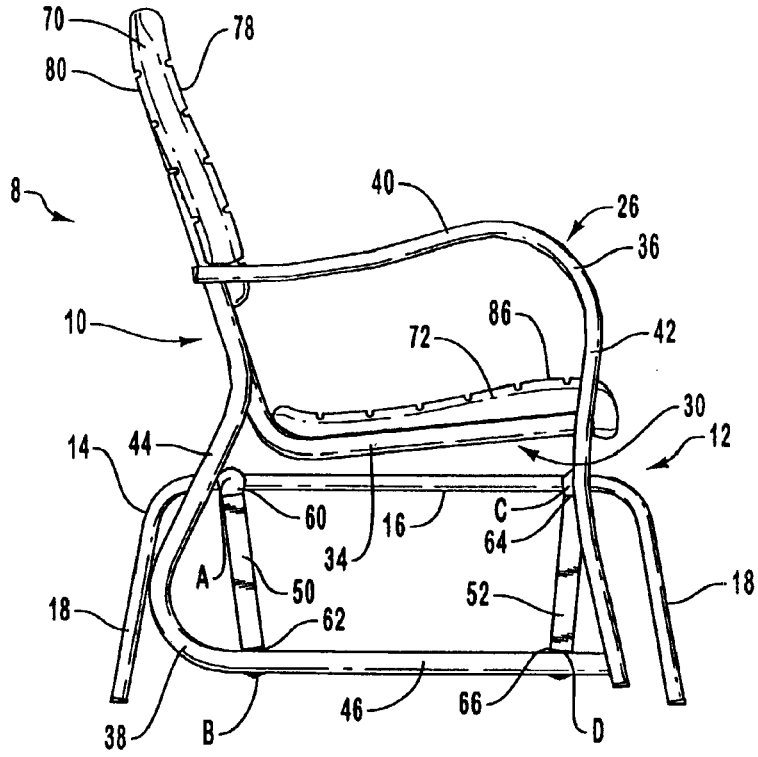
FIG. 3 is a left side view of the glider bench shown in FIG. 1.
Figure 4:
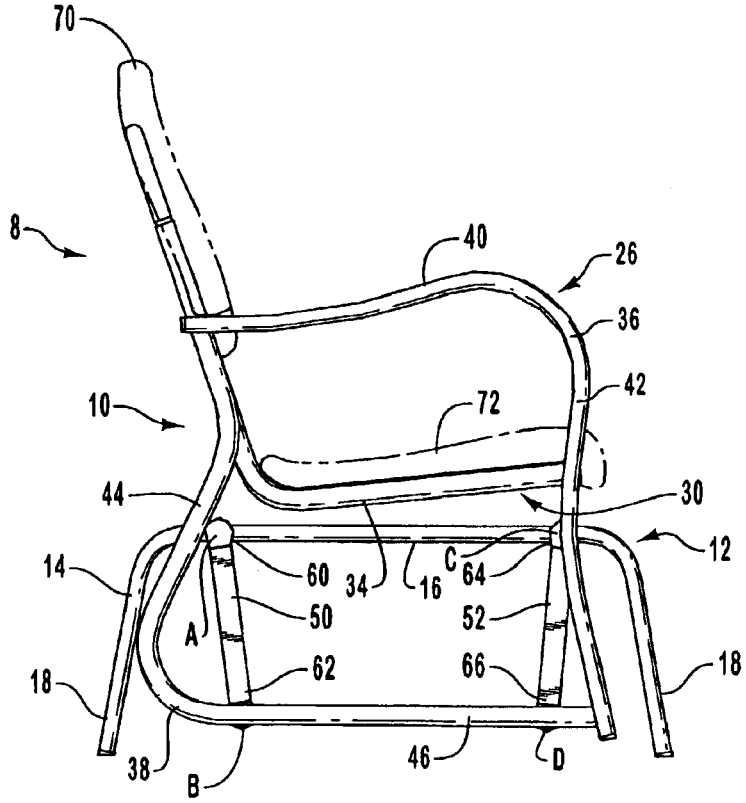
FIG. 4 is a left side view of the glider bench shown in FIG. 1, illustrating the bench seat and back in broken lines.

As best seen in FIGS. 3 and 4, the arm support portion 26 of the frame 22 includes a first generally L-shaped member 36 and a second generally L-shaped member 38. The first generally L-shaped member 36 includes a generally horizontal portion 40 that is sized and configured to form or support an armrest for the glider bench 8 and a generally downwardly extending portion 42. The second generally L-shaped member 38 includes a generally vertical portion 44 that is connected to the generally horizontal portion 40 of the first generally L-shaped member 36 and a generally horizontal portion 46 that is connected to the generally vertical portion 42 of the first generally L-shaped member. The first and second generally L-shaped members 36, 38 are preferably connected to form a generally rectangular or square configuration, but it will be appreciated that the first and second generally L-shaped members may have any desirable size and configuration. In addition, the arm support portion 26 may have any suitable size and configuration depending, for example, upon the size and configuration of the frame 22 or the glider bench 8.

The first and second generally L-shaped members 36, 38 are preferably welded together to form a strong and rigid arm support portion 26, but one skilled in the art will understand that the first and second generally L-shaped members can be connected in any suitable manner. The first and second generally L-shaped members 36, 38 may also be integrally formed as a single structure or multiple components that are interconnected. The first and second generally L-shaped members 36, 38 are preferably constructed from metal and, in particular, from hollow metal tubes. It will be understood that the first and second generally L-shaped members 36, 38 may be constructed from other materials with desired characteristics and the members may have other suitable shapes and configurations depending, for example, upon the type of materials used to construct the members, or the intended use of the glider chair 8.

The back and seat support 24 and the arm support 26 of the frame 22 are connected together by fasteners such as bolts, screws, rivets and the like. In particular, the back and seat support portion 24 is preferably connected to the first and second generally L-shaped members 36, 38 of the arm support 26 by the fasteners. One skilled in the art will appreciate that the back and seat support 24 and the arm support 26 portions of the frame 22 can be connected using any suitable methods or means, including welding, riveting, adhesives, and the like, and these components may also be constructed from a single, unitary member. Further, the back and seat support 24 and arm support 26 portions of the frame 22 may have other suitable configurations depending, for example, upon the intended configuration of the frame and/or glider bench 8.

The bench 10 and base 12 are movably connected to provide the gliding motion of glider bench 8. In particular, a linkage or glider mechanism interconnects the bench frame 22 and the base 10 to allow the glider bench 8 to rock or swing. The linkage mechanism includes a first pair of links 50, 52 disposed on one side of the glider bench 8 and a second pair of links 54, 56 disposed on an opposing side of the bench. The links 50, 52, 54, 56 are disposed between the frame 22 and the base 12, and the links preferably form part of a four-bar linkage.

In greater detail, as best seen in FIGS. 3 and 4, the first link 50 has a first end 60 that is pivotally attached at point A to the connecting member 16 of the first support member 18. The first link 50 has a second end 62 that is pivotally attached at point B to a generally horizontal portion 46 of the second generally L-shaped member 38 of the arm support 26. The second link 52 is spaced apart from the first link 50 and it includes a first end 64 that is pivotally attached at point C to the connecting member 16 of the first support member 18 and a second end 66 that is pivotally attached at point D to a generally horizontal portion 46 of the second generally L-shaped member 38 of the arm support 26. Similarly, the links 54, 56 are disposed on the other side of the glider bench 8 and these links interconnect frame 22 to the base 12.

The links 50, 52, 54 and 56 may be pivotally attached to the base 12 and the frame 22 by bolts, screws, rivets, pins, and the like. Desirably, the links 50, 52, 54 and 56 are attached to the base 12 and the frame 22 by using one or more bushings, bearings, washers, etc. to facilitate the pivotal connection of the links to the base and the frame. Advantageously, the bushings, bearings, washers, etc. may allow for the smooth gliding motion of the frame 22 relative to the base 12 and these components may allow the glider bench 8 to freely move. It will be appreciated, however, that the bushings, bearings, washers, etc. are not required to construct the glider bench 8.

The links 50, 52, the connecting portion 16 of the support member 14, and the lower generally horizontal portion 46 of the arm support portion 26 of the frame 22 preferably form a four bar linkage that interconnects the base 12 and the frame 22. As shown in the accompanying figures, the first link 50 is preferably angled slightly towards the back of the glider bench 8 and the second link 52 is preferably angled slightly towards the front of the bench, but it will be appreciated that the links can have any suitable alignment and orientation. Additionally, it will be appreciated that the links 50, 52, the connecting portion 16 of the support member 14, and the lower generally horizontal portion 46 of the arm support 26 do not have to be interconnected to connect the base 12 to the frame 22. In contrast, any suitable portions of the base 12 and frame 22 may be connected to allow movement of the bench 10 relative to the base to form the glider bench 8.

Advantageously, the links 50, 52, 54 and 56 allow the glider bench 8 to move backward and forward with a smooth gliding motion. Desirably, the bench portion 10 freely swings forward and backward, and the bench does not undesirably rotate in a sideways direction. Additionally, the bench 10 preferably moves in a stable, predictable manner to create a steady and expected motion.

Significantly, the base 12 and frame 22 of the glider bench 8 can be constructed with a minimum number of components and it is easy to manufacture and assemble. It will be appreciated, however, that the glider bench 8 can have other suitable configurations and there are a variety of ways to connect the base 12 to the frame 22. Additionally, as discussed above, the base 12 and the frame 22 are preferably constructed from metal and these metal components preferably have a tubular configuration for relatively high-strength and lightweight. These metal components are preferably powder-coated to prevent the metal from rusting or corroding due to environmental factors such as rain or snow. The base 12 and the frame 22 may also be constructed from other materials with suitable characteristics, and the shape and configuration of the components may vary depending, for example, upon the type of materials used to construct the components. For example, if the base 12 and the frame 22 are constructed from metal, then these components may have an oval, rectangular, square or other cross-sectional configuration. Additionally, the base 12 and the frame 22 do not have to be constructed with a tubular or hollow configuration and, in contrast, the base and frame could be formed from solid materials.

As seen in FIGS. 1 and 2, a bench back 70 and bench seat 72 are connected to the frame 22. In particular, the bench back 70 is connected to the back support portion 28 of the back and seat support 24, and the bench seat 72 is connected to the seat support portion 30 of the back and seat support. The bench back 70 includes a first end 74, a second end 76, a front surface 78 and a rear surface 80. The bench seat 72 includes a first end 82, a second end 84, a top surface 86 and a bottom surface 88. It will be appreciated that while the back 70 and seat 72 may include one or more of the following features, the back and seat may include different features and have different configurations.

Figure 5:
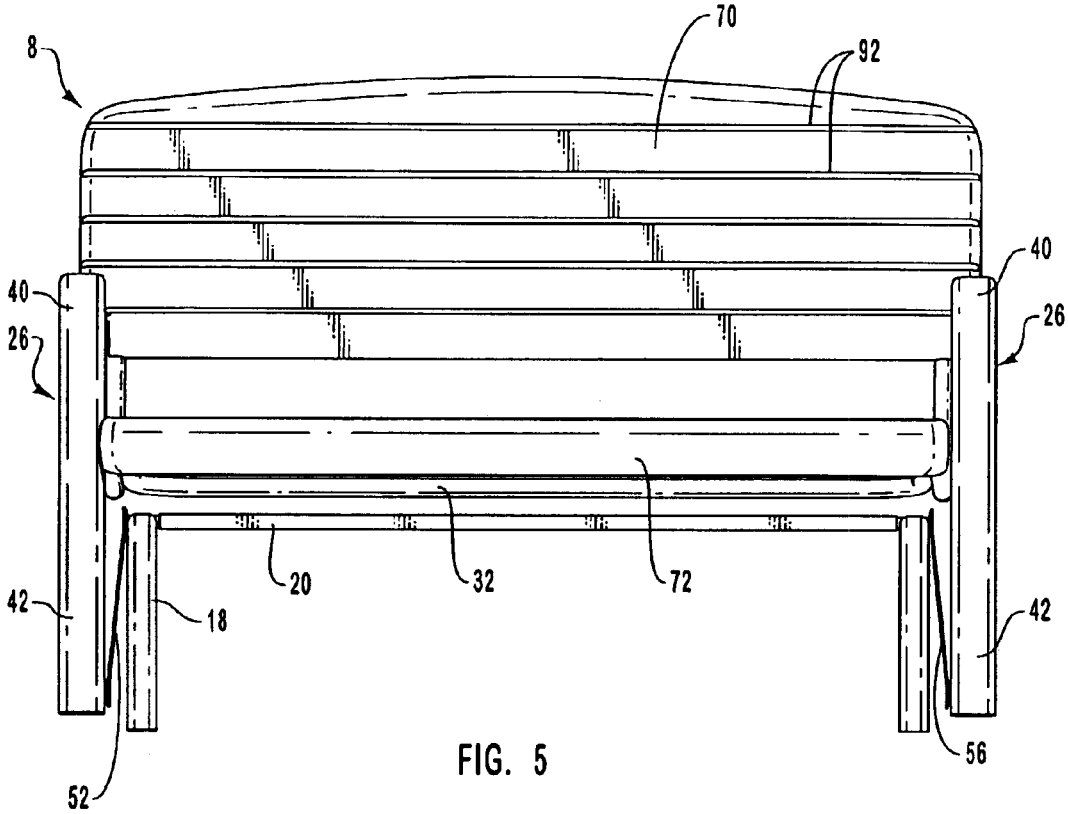
FIG. 5 is a front view of the glider bench shown in FIG. 1.

As best seen in FIGS. 1 and 5, the bench back 70 and the bench seat 72 each have a generally rectangular configuration with slightly rounded corners and a lip 90 is located on the front of the seat for increased comfort of the users. It will be appreciated that the bench back 70 and the bench seat 72 may have any suitable shapes and configurations depending, for example, upon the size and configuration of the glider bench 8. Additionally, if desired, the bench back 70 and the bench seat 72 could be a unitary one-piece structure or the back and seat may consist of two or more components that are interconnected or independently attached to the chair frame 22.

The bench back 70 and the bench seat 72 may also be contoured for increased comfort of the user. In particular, the bench back 70 and the bench seat 72 may be curved to conform to the natural curves of the human body. For example, as seen in FIG. 3, the bench back 70 is curved to provide lumbar support for the user and the bench seat 72 may also be curved to provide a more comfortable, ergonomic position for the user. Significantly, the contoured bench back 70 and the bench seat 72 may be formed during the manufacturing process, which may save time and costs.

The bench back 70 and the bench seat 72 are preferably constructed from plastic and, in particular, from blow-molded plastic. Advantageously, blow-molded plastic allows a strong and lightweight bench back 70 and bench seat 72 to be constructed. In particular, the blow-molded bench back 70 and seat 72 preferably include two opposing walls or surfaces that are separated by a given distance in order to create a strong and sturdy structure. In addition, the interior portion of the blow-molded bench back 70 and seat 72 are preferably generally hollow. Advantageously, this creates a bench back 70 and seat 72 that are lightweight, strong and rigid, and are relatively easy to manufacture. Significantly, because the blow-molded plastic bench back 70 and the bench seat 72 are generally hollow, the back and seat are lightweight. This may allow a lightweight frame 22 to be used to support the bench back 70 and seat 72 because the frame does not have to support heavy back and seat members.

The bench back 70 and the bench seat 72 may be constructed from a variety of different types of plastics with suitable characteristics. For example, the bench back 70 and the bench seat 72 may be constructed from low-density polyethylene or a high-density polyethylene with the desired characteristics. Significantly, the blow-molded plastic is generally weather resistant, corrosion resistant and temperature insensitive. This allows a strong, long-lasting bench back 70 and seat 72 to be constructed. Advantageously, the blow-molded plastic bench back 70 and seat 72 generally do not corrode, rust or otherwise deteriorate over time.

The bench back 70 and seat 72 preferably is constructed from lightweight, blow-molded plastic because weight reduction of the glider chair 8 may be highly desirable. For example, constructing the bench back 70 and seat 72 from lightweight blow-molded plastic may allow shipping costs to be decreased. In addition, because glider benches 8 may be marketed directly to consumers in retail stores a lightweight glider bench may be very important. In particular, because consumers may be required to bring the glider bench 8 to a register to be purchased, load the bench into a vehicle, and assemble the bench at home, they may desire a lightweight glider bench. Consumers may be reluctant to purchase a glider bench that is too heavy.

Advantageously, the bench back 70 and the bench seat 72 may include multiple features that are integrally formed in the back and seat during the blow-molding process. For example, a plurality of grooves 92 may be formed in the front surface 78 of the bench back 70 and the top surface 86 of the bench seat 72 to create the appearance of wooden slats that are used to create a conventional wooden bench. These grooves 92 may also be formed in the rear surface 80 of the bench back 70 and the bottom surface 88 of the bench seat 72. The front surface 78 of the bench back 70 and the top surface 86 of the bench seat 72 may also be textured, if desired.

One or more receiving channels 94 may also be formed in the rear surface 80 of the bench back 70 and the bottom surface 88 of the bench seat 72 to allow the chair frame 12 to be attached. Preferably, at least a portion of the receiving channels 94 generally conform to the shape of the corresponding frame 22 so that at least part of the frame may fit snugly into the receiving channel. Additionally, the receiving channels 94 may be sized and configured to receive the frame 22 by a snap, friction or interference fit to attach the bench back 70 and the bench seat 72 to the frame. It will be appreciated, however, that the receiving channels 94 may have any desired shape or configuration, and one or more fasteners may be used to in conjunction with the receiving channels to attach the bench back 70 and seat 72 to the frame 22.

Figure 7:
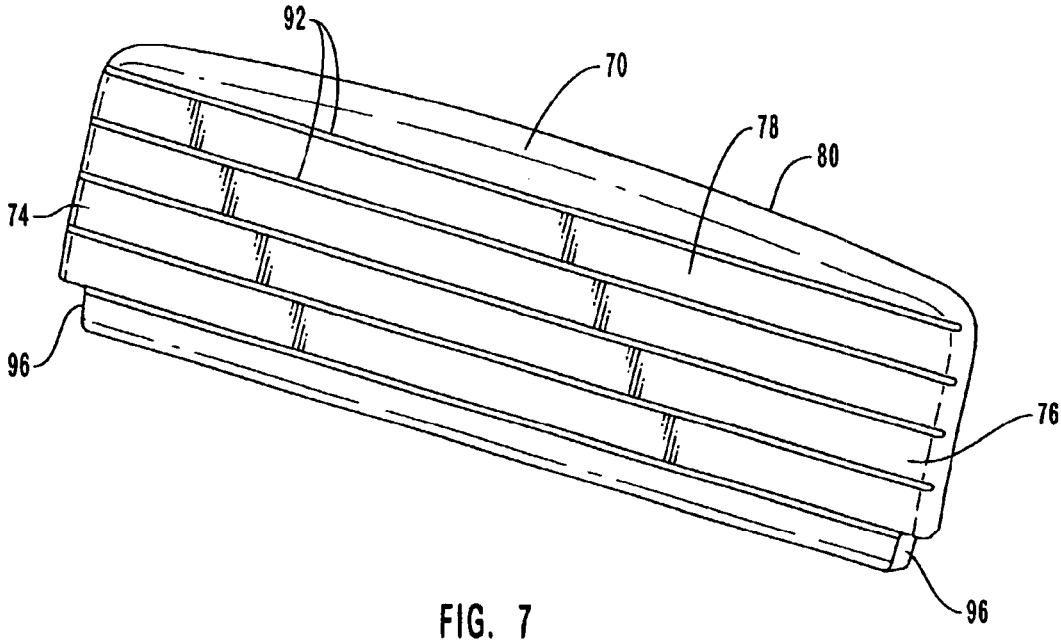
FIG. 7 is an enlarged front perspective view of a portion of a glider chair in accordance with another preferred embodiment of the invention, illustrating only the back portion of the bench.
Figure 8:
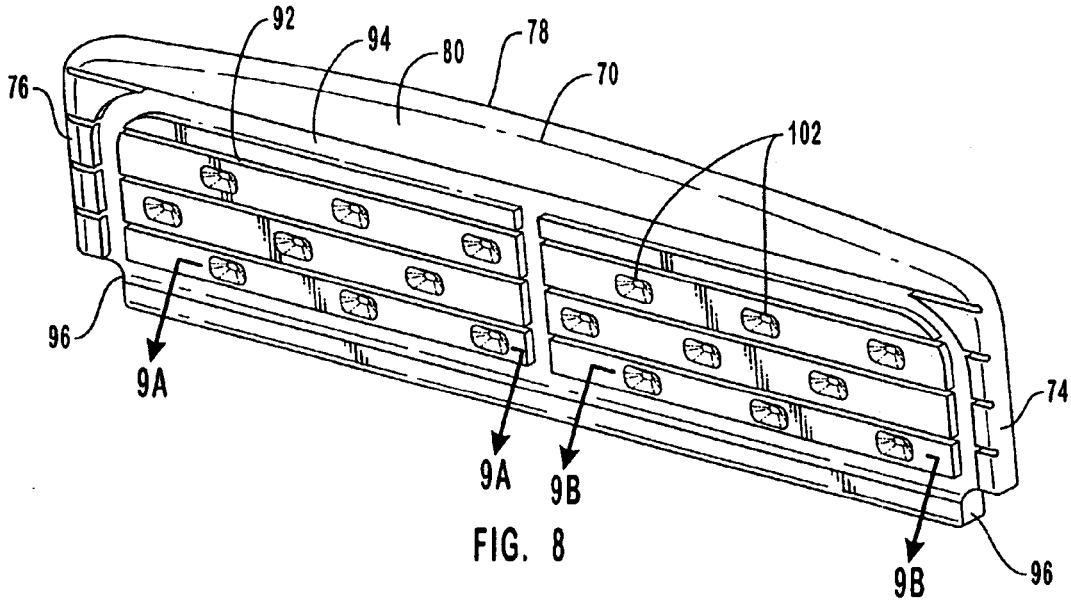
FIG. 8 is a rear perspective view of the bench back shown in FIG. 7, illustrating exemplary depressions in the bench back.

Further, as best seen in FIGS. 7 and 8, the bottom portion of the bench back 70 may include cutouts 96 to assist in mounting the bench back to the frame 22. The bench back 70 and the bench seat 72 may include other features that facilitate attachment of the back and seat to the frame 22. Significantly, these and other features may be simultaneously formed in the bench back 70 and the bench seat 72.

The bench back 70 and seat 72 are preferably constructed as unitary, one-piece structures. Advantageously, this further decreases manufacturing costs and time because one or more components do not have to be assembled or fastened together to form the back or seat. It will be appreciated that the bench back 70 and seat 72 may be constructed as a single member, or by one or more components that are fastened together by any suitable means.

Figure 10A:
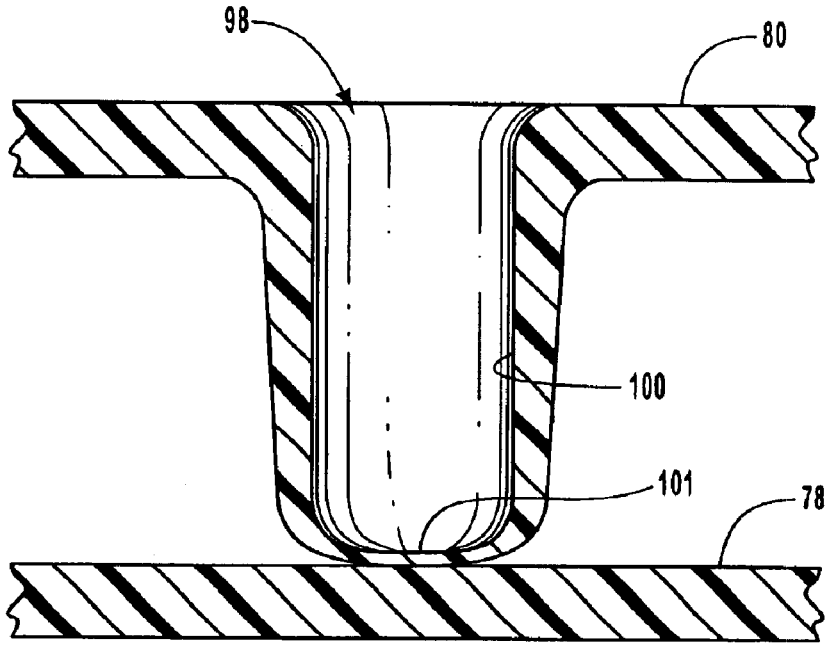
FIG. 10A is an enlarged cross-sectional side view of a preferred embodiment of a screw boss that can be used in conjunction with the glider bench, illustrating the end of the screw boss contacting an opposing surface.
Figure 10B:
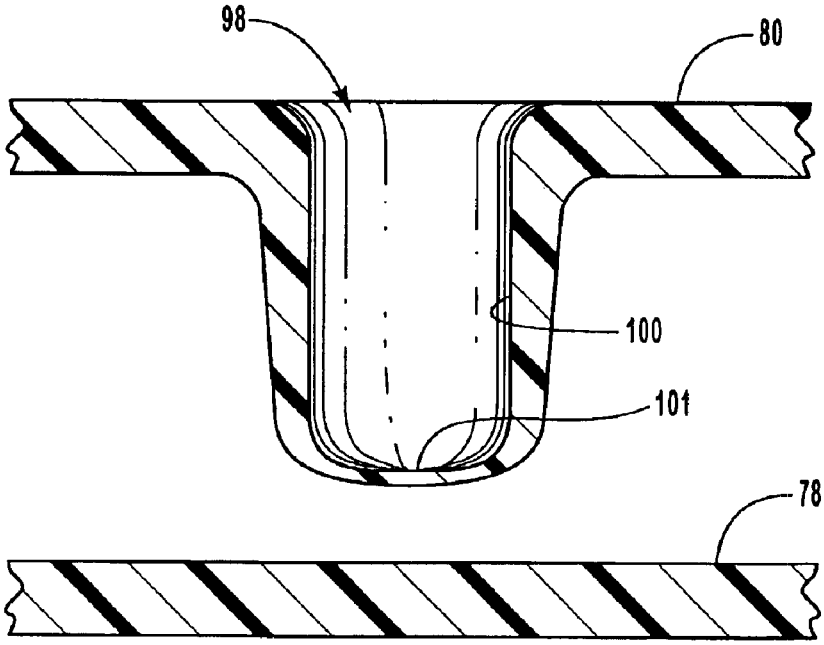
FIG. 10B is an enlarged cross-sectional side view of another preferred embodiment of a screw boss that can be used in conjunction with the glider bench, illustrating the end of the screw boss being spaced apart from an opposing surface.

As discussed above, the bench back 70 and the bench seat 72 may be attached to the frame 22 by one or more fasteners such as bolts, screws, rivets and the like. It will be appreciated that any suitable type of fastener, adhesives, and the like may be used to attach the bench back 70 and the bench seat 72 to the fame 22. Desirably, as shown in FIGS. 10A and 10B, the bench back 70 and/or bench seat 72 may include one or more screw bosses 98 to allow a fastener to connect the bench back or seat to the frame 22. The screw boss 98, for example, may be located in the rear surface 80 of the bench back 70 and it can extend towards the front surface 78 of the back. The screw boss 98 includes a wall 100 and a distal end 101 that may contact the opposing surface as shown in FIG. 10A or may not contact the opposing surface as shown in FIG. 10B. The screw boss 98 advantageously allows the fastener to be securely attached to the bench back 70. It will be appreciated that the dimensions and size of the screw boss 98 may vary depending, for example, upon the size of the fastener or intended use of the glider bench 8.

Desirably, in order to provide a secure attachment for the fastener, a least two threads of the fastener should engage the wall 100 of the screw boss 98. The thickness of the wall 100 should be sufficient to allow engagement of the threads of the fastener 100 without the threads piercing the wall. It will be appreciated that the thickness and the depth of the screw boss 98 may be a function of the position of the screw boss as well as a function of the load applied to fastener.

The screw boss 98 is desirably located in a stretch region of the bench back 70 which allows the screw boss to be formed without piercing the back or creating a portion of the back in which the plastic is too thin. Additionally, the screw boss 98 may be created with an open or closed distal end 101. These and other features of a screw boss that may be used in conjunction with the glider bench 8 are described in detail in assignee's co-pending U.S. patent application Ser. No. 10/005,933, entitled Screw Bosses for Blow-Molded Structures, which was filed on Dec. 5, 2001, and is hereby incorporated by reference in its entirety.

Figure 6:
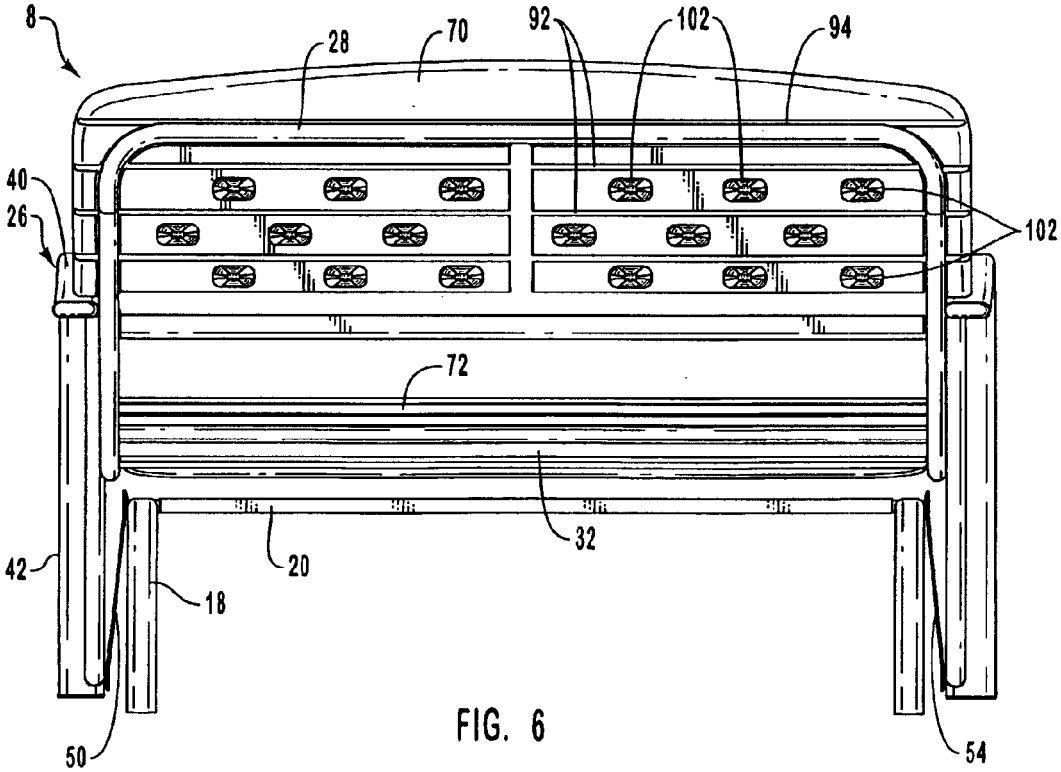
FIG. 6 is a rear view of the glider bench shown in FIG. 1, illustrating exemplary depressions in the back of the bench.

As shown in FIGS. 6 and 8, the rear surface 80 of the bench back 70 and the bottom surface 88 of the bench seat 72 may include a plurality of depressions 102 or "tack offs." The depressions 102, which extend from one surface towards the other surface, are desirably sized and configured to increase the strength and/or rigidity of the bench back 70 and seat 72. In greater detail, the depressions 102 are desirably formed in the rear surface 80 of the bench back 70 and/or the bottom surface 88 of the bench seat 72 so that the depressions are generally not visible. The depressions 102, however, could be formed in any desired portions of the bench back 70 and/or bench seat 72. For example, one or more depressions 102 may be formed in the rear surface 80 of the bench back 70 and one or more depressions may be formed in the front surface 78 of the bench back, and these opposing depressions may be aligned. If desired, a portion of these opposing depressions 102 contact or engage each other, but the opposing depressions do not have to touch or engage. The depressions 102 may cover a substantial portion of the bench back 70 or seat 72, or only a small portion of the bench back and seat. One skilled in the art will appreciate that the number, size and location of the depressions 102 may depend upon factors such as the desired strength of the bench back 70 and/or bench seat 72 and that the glider bench 8 does not require one or more depressions.

Figure 9A:
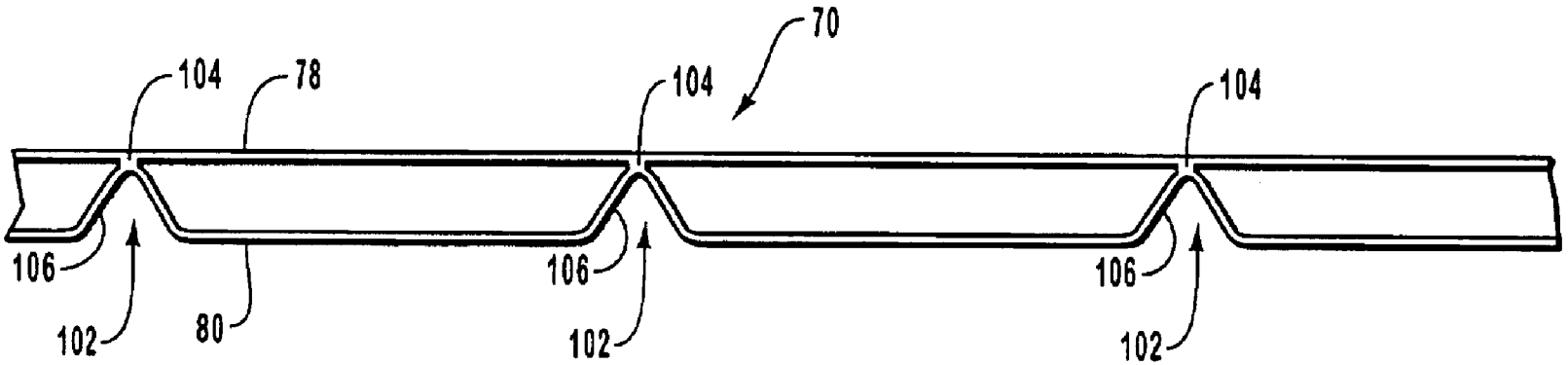
FIG. 9A is an enlarged cross-sectional side view along lines 9A—9A of the bench back shown in FIG. 8, illustrating one embodiment of a depression.
Figure 9B:
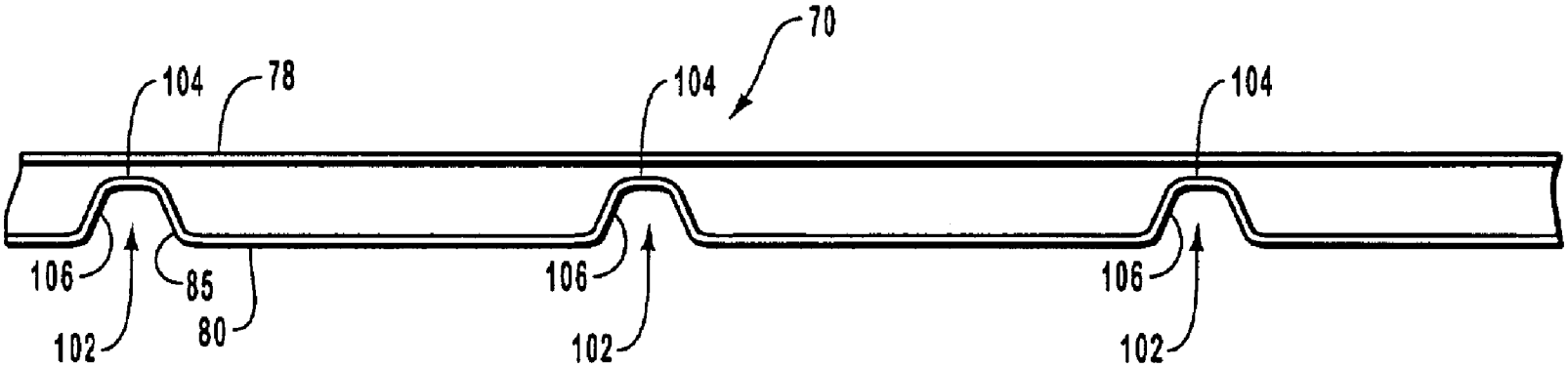
FIG. 9B is a cross-sectional side view along lines 9B—9B of the bench back shown in FIG. 8, illustrating another embodiment of a depression.

The depressions 102 are desirably formed during the blow-molding process and the depressions may be formed by placing a pin in the mold during the blow molding process. The pin causes the plastic material to stretch and deform into the depression 102. For example, a depression 102 may be formed in the rear surface 80 of the bench back 70 and the length of the pin may cause the end 104 of the depression to contact the front surface 78 of the bench back, as illustrated in FIG. 9A. The depression 102, however, may only extend partially into generally hollow interior portion of the bench back 70 and the end 104 of the depression may not contact front surface 78 of the bench back 70, as illustrated in FIG. 9B. Advantageously, because the depressions 102 can be formed during the blow-molding process, that may eliminate a step during the manufacturing process.

Additionally, while the depressions 102 have been described as being formed in the rear surface 80 of the bench back 70, it will be appreciated that depressions may be formed in the front surface 78 of the bench back, the bottom surface 88 of the bench seat 72, and/or the top surface 86 of the seat if desired. Additionally, one or more depressions 102 may be formed on both the front and rear surfaces 78, 80 of the bench back 70 or the top and bottom surfaces 86, 88 of the bench seat 72.

As seen in FIGS. 6 and 8, the depressions 102 preferably have generally tapered walls 106 and the end 104 of the depression may contact or engage the inner surface of the opposing wall. As discussed above, the end 104 of the depression 102 does not have to contact or engage an opposing surface. As shown in the accompanying figures, the depressions 102 preferably have a generally trapezoidal configuration. Advantageously, the trapezoidal configuration may provide desirable bearing and torsional characteristics for the bench back 70 and/or seat 72. For example, the trapezoidal shape appears to prevent the bench back 70 and/or bench seat 72 from undesirably bending or yielding.

Advantageously, the blow-molded plastic bench back 70 and/or seat 72 allows the glider bench 8 to be constructed using a minimum of materials and components. In addition, the blow-molded plastic structures may reduce the number of steps required to construct the glider bench 8 and may allow the bench to be assembled more easily. Significantly, the transportation, storage, and shipping costs may be greatly reduced because a strong, yet lightweight glider bench 8 can be constructed. Further, the blow-molded plastic bench back 70 and the bench seat 72 allow the glider bench 8 to be used indoors and outdoors.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A glider bench comprising:

a base;

a frame movable relative to the base;

a blow-molded plastic bench seat connected to the frame, the blow-molded plastic bench seat including a front surface that is separated by a generally constant distance from a bottom surface;

a plurality of depressions formed in the bottom surface of the bench seat, each of the plurality of depressions including an end that is disposed towards the front surface of the bench seat, the plurality of depressions covering at least a substantial portion of the bottom surface of the bench seat, the plurality of depressions being sized and configured to increase the strength of the bench seat;

a blow-molded plastic bench back connected to the frame, the blow-molded plastic bench back including a front surface that is separated by a generally constant distance from a rear surface;

a plurality of depressions formed in the rear surface of the bench back, each of the plurality of depressions including an end that is disposed towards the front surface of the bench back, the plurality of depressions covering at least a substantial portion of the rear surface of the bench back, the plurality of depressions being sized and configured to increase the strength of the bench back; and a glider mechanism interconnecting the frame and the base, the glider mechanism capable of allowing the frame to move in a gliding motion relative to the base.

2. The glider bench as in claim 1, wherein at least a majority of the ends of the plurality of depressions formed in the bottom surface of the bench seat contact the front surface of the bench seat and at least a majority of the ends of the plurality of depressions formed in the rear surface of the bench back contact the front surface of the bench back.

3. The glider bench as in claim 1, wherein at least a majority of the ends of the plurality of depressions formed in the bottom surface of the bench seat are spaced apart from the front surface of the bench seat and at least a majority of the ends of the plurality of depressions formed in the rear surface of the bench back are spaced apart from the front surface of the bench back.

4. The glider bench as in claim 1, wherein the glider mechanism further comprises:

a first link disposed on a left side and towards a front portion of the glider bench, the first link including a lower portion that is pivotally connected to the frame and an upper portion that is pivotally connected to the base, the pivotal connection of the first link to the base being generally aligned with or disposed forward of frame when the glider bench is in a stationary position;

a second link disposed on the left side and towards a rear portion of the glider bench, the second link including a lower portion that is pivotally connected to the frame and an upper portion that is pivotally connected to the base, the second link being angled towards the rear portion of the glider bench when the glider bench is in the stationary position;

a third link disposed on a right side and towards the front portion of the glider bench, the third link including a lower portion that is pivotally connected to the frame and an upper portion that is pivotally connected to the base, the pivotal connection of the third link to the base being generally aligned with or disposed forward of frame when the glider bench is in the stationary position; and a fourth link disposed on the right side and towards the rear portion of the glider bench, the fourth link including a lower portion that is pivotally connected to the frame and an upper portion that is pivotally connected to the base, the fourth link being angled towards the rear portion of the glider bench when the glider bench is in the stationary position.

5. The glider bench as in claim 1, further comprising a generally U-shaped receiving channel formed in the rear surface of the bench back that is sized and configured to receive a generally U-shaped portion of the frame.

6. The glider bench as in claim 1, further comprising at least one groove formed in the front surface of the bench seat, the groove being formed as an integral part of a unitary, one-piece blow-molded plastic bench seat.

7. The glider bench as in claim 1, further comprising at least one groove formed in the front surface of the bench back, the groove being formed as an integral part of a unitary, one-piece blow-molded plastic bench back.

8. The glider bench as in claim 1, wherein the frame include a first arm support portion with a first generally L-shaped member that is connected to a second generally L-shaped member; and wherein the frame including a second arm support portion with a first generally L-shaped member that is connected to a second generally L-shaped member.

9. A glider bench comprising:

a base;

a frame movable relative to the base, the frame including a generally U-shaped back support portion;

a blow-molded plastic bench seat connected to the frame;

a blow-molded plastic bench back including a generally U-shaped receiving channel that is integrally formed in the bench back as part of a unitary, one-piece construction, the generally U-shaped back support portion of the frame being disposed within the generally U-shaped receiving channel; and a glider mechanism interconnecting the frame and the base, the glider mechanism capable of allowing the frame to move in a gliding motion relative to the base.

10. The glider bench as in claim 9, further comprising a plurality of depressions formed in a bottom surface of the bench seat, each of the plurality of depressions including an end that is disposed towards a front surface of the bench seat, the plurality of depressions covering at least a substantial portion of the bottom surface of the bench seat, the plurality of depressions being sized and configured to increase the strength of the bench seat; and a plurality of depressions formed in a rear surface of the bench back, each of the plurality of depressions including an end that is disposed towards a front surface of the bench back, the plurality of depressions covering at least a substantial portion of the rear surface of the bench back, the plurality of depressions being sized and configured to increase the strength of the bench back.

11. The glider bench as in claim 10, wherein at least a majority of the ends of the plurality of depressions formed in the bottom surface of the bench seat contact the front surface of the bench seat and at least a majority of the ends of the plurality of depressions formed in the rear surface of the bench back contact the front surface of the bench back.

12. The glider bench as in claim 10, wherein at least a majority of the ends of the plurality of depressions formed in the bottom surface of the bench seat are spaced apart from the front surface of the bench seat and at least a majority of the ends of the plurality of depressions formed in the rear surface of the bench back are spaced apart from the front surface of the bench back.

13. The glider bench as in claim 9, wherein the glider mechanism further comprises:

a first link disposed on a left side and towards a front portion of the glider bench, the first link including a lower portion that is pivotally connected to the frame and an upper portion that is pivotally connected to the base, the pivotal connection of the first link to the base being generally aligned with or disposed forward of frame when the glider bench is in a stationary position;

a second link disposed on the left side and towards a rear portion of the glider bench, the second link including a lower portion that is pivotally connected to the frame and an upper portion that is pivotally connected to the base, the second link being angled towards the rear portion of the glider bench when the glider bench is in the stationary position;

a third link disposed on a right side and towards the front portion of the glider bench, the third link including a lower portion that is pivotally connected to the frame and an upper portion that is pivotally connected to the base, the pivotal connection of the third link to the base being generally aligned with or disposed forward of frame when the glider bench is in the stationary position; and a fourth link disposed on the right side and towards the rear portion of the glider bench, the fourth link including a lower portion that is pivotally connected to the frame and an upper portion that is pivotally connected to the base, the fourth link being angled towards the rear portion of the glider bench when the glider bench is in the stationary position.

14. The glider bench as in claim 9, further comprising at least one groove formed in the front surface of the bench seat, the groove being formed as an integral part of a unitary, one-piece blow-molded plastic bench seat.

15. The glider bench as in claim 9, further comprising at least one groove formed in the front surface of the bench back, the groove being formed as an integral part of a unitary, one-piece blow-molded plastic bench back.

16. The glider bench as in claim 9, wherein the frame include a first arm support portion with a first generally L-shaped member that is connected to a second generally L-shaped member; and wherein the frame including a second arm support portion with a first generally L-shaped member that is connected to a second generally L-shaped member.

17. A glider bench comprising:

a base;

a frame movable relative to the base, the frame including a first arm support portion with a first generally L-shaped member that is connected to a second generally L-shaped member, the frame including a second arm support portion with a first generally L-shaped member that is connected to a second generally L-shaped member;

a blow-molded plastic bench seat connected to the frame;

a blow-molded plastic bench back connected to the frame;

a glider mechanism interconnecting the frame and the base, the glider mechanism capable of allowing the frame to move in a gliding motion relative to the base; and a generally U-shaped receiving channel that is integrally formed in the rear surface of the bench back as part of a unitary, one-piece construction, the generally U-shaped receiving channel being sized and configured to receive a generally U-shaped portion of the frame.

18. A glider bench comprising:

a base;

a frame movable relative to the base;

a blow-molded plastic bench seat connected to the frame;

a blow-molded plastic bench back connected to the frame;

a glider mechanism interconnecting the frame and the base, the glider mechanism capable of allowing the frame to move in a gliding motion relative to the base, the glider mechanism comprising:

a first link disposed on a left side and towards a front portion of the glider bench, the first link including a lower portion that is pivotally connected to the frame and an upper portion that is pivotally connected to the base, the pivotal connection of the first link to the base being generally aligned with or disposed forward of frame when the glider bench is in a stationary position;

a second link disposed on the left side and towards a rear portion of the glider bench, the second link including a lower portion that is pivotally connected to the frame and an upper portion that is pivotally connected to the base, the second link being angled towards the rear portion of the glider bench when the glider bench is in the stationary position;

a third link disposed on a right side and towards the front portion of the glider bench, the third link including a lower portion that is pivotally connected to the frame and an upper portion that is pivotally connected to the base, the pivotal connection of the third link to the base being generally aligned with or disposed forward of frame when the glider bench is in the stationary position; and a fourth link disposed on the right side and towards the rear portion of the glider bench, the fourth link including a lower portion that is pivotally connected to the frame and an upper portion that is pivotally connected to the base, the fourth link being angled towards the rear portion of the glider bench when the glider bench is in the stationary position; and a generally U-shaped receiving channel that is integrally formed in the rear surface of the bench back as part of a unitary, one-piece construction, the generally U-shaped receiving channel being sized and configured to receive a generally U-shaped portion of the frame.

19. The glider bench as in claim 18, further comprising at least one groove formed in the front surface of the bench seat, the groove being formed as an integral part of a unitary, one-piece blow-molded plastic bench seat.

20. The glider bench as in claim 18, further comprising at least one groove formed in the front surface of the bench back, the groove being formed as an integral part of a unitary, one-piece blow-molded plastic bench back.

21. The glider bench as in claim 18, wherein the frame includes a first arm support portion with a first generally L-shaped member that is connected to a second generally L-shaped member; and wherein the frame includes a second arm support portion with a first generally L-shaped member that is connected to a second generally L-shaped member.

* * * * *

UNITED STATES PATENT AND TRADEMARK OFFICE

CERTIFICATE OF CORRECTION

PATENT NO. : 6,877,810 B2
DATED : April 12, 2005
INVENTOR(S) : Anthony D. Barfield It is certified that error appears in the above-identified patent and that said Letters Patent is hereby corrected as shown below:

Column 2,
Line 49, change “fame” to -- frame --.

Column 4,
Lien 15, change “limits” to -- limit --.

Column 9,
Line 45, after “be used” remove “to”.

Column 12,
Line 67, change “include” to -- includes --.

Column 13,
Line 2, change “including” to -- includes --.

Column 14,
Line 22, change “include” to -- includes --.
Line 24, change “including” to -- includes --.

Signed and Sealed this

Twenty-third Day of August, 2005

JON W. DUDAS
*Director of the United States Patent and Trademark Office*